US006572761B2

(12) United States Patent
Lyon

(10) Patent No.: US 6,572,761 B2
(45) Date of Patent: Jun. 3, 2003

(54) METHOD FOR EFFICIENT AND ENVIRONMENTALLY CLEAN UTILIZATION OF SOLID FUELS

(75) Inventor: Richard K. Lyon, Pittstown, NJ (US)

(73) Assignee: General Electric Company, Schenectady, NY (US)

( * ) Notice: Subject to any disclaimer, the term of this patent is extended or adjusted under 35 U.S.C. 154(b) by 40 days.

(21) Appl. No.: 09/917,798

(22) Filed: Jul. 31, 2001

(65) Prior Publication Data

US 2003/0024853 A1 Feb. 6, 2003

(51) Int. Cl.[7] ..... C10G 47/24; C10G 11/00; C10G 47/04

(52) U.S. Cl. ..... 208/113; 208/108; 208/112; 210/237; 210/345; 210/346

(58) Field of Search ..... 110/237, 345, 110/346; 208/108, 112, 113

(56) References Cited

U.S. PATENT DOCUMENTS

| | | | |
|---|---|---|---|
| 5,339,754 A | 8/1994 | Lyon | 110/345 |
| 5,509,362 A | 4/1996 | Lyon | 110/345 |
| 5,827,496 A | 10/1998 | Lyon | 423/659 |

*Primary Examiner*—Walter D. Griffin
*Assistant Examiner*—Tam M. Nguyen
(74) *Attorney, Agent, or Firm*—Nixon & Vanderhye P.C.

(57) ABSTRACT

A process of oxidizing an ash and sulfur containing fuel such as coal in order to power gas turbines using a material such as the oxides of iron which in an oxidized state can be readily reduced and which in a reduced state is readily oxidized. Preferably, the oxides of iron are circulated between two fluid bed reactors and reduced by the ash and sulfur containing fuel in the first said fluid bed reactor and oxidized by air in the second said fluid bed reactor, with ash and $SO_2$ in the gases leaving chiefly from the first said fluid bed reactor. The temperature is controlled within the second said fluid bed reactor by use of a clean fuel and the rate of addition of the ash and sulfur containing fuel to the second fluid bed is controlled so as to limit the amount of $SO_2$ in the gases leaving the second said fluid bed.

7 Claims, 1 Drawing Sheet

Circulating fluidized bed system

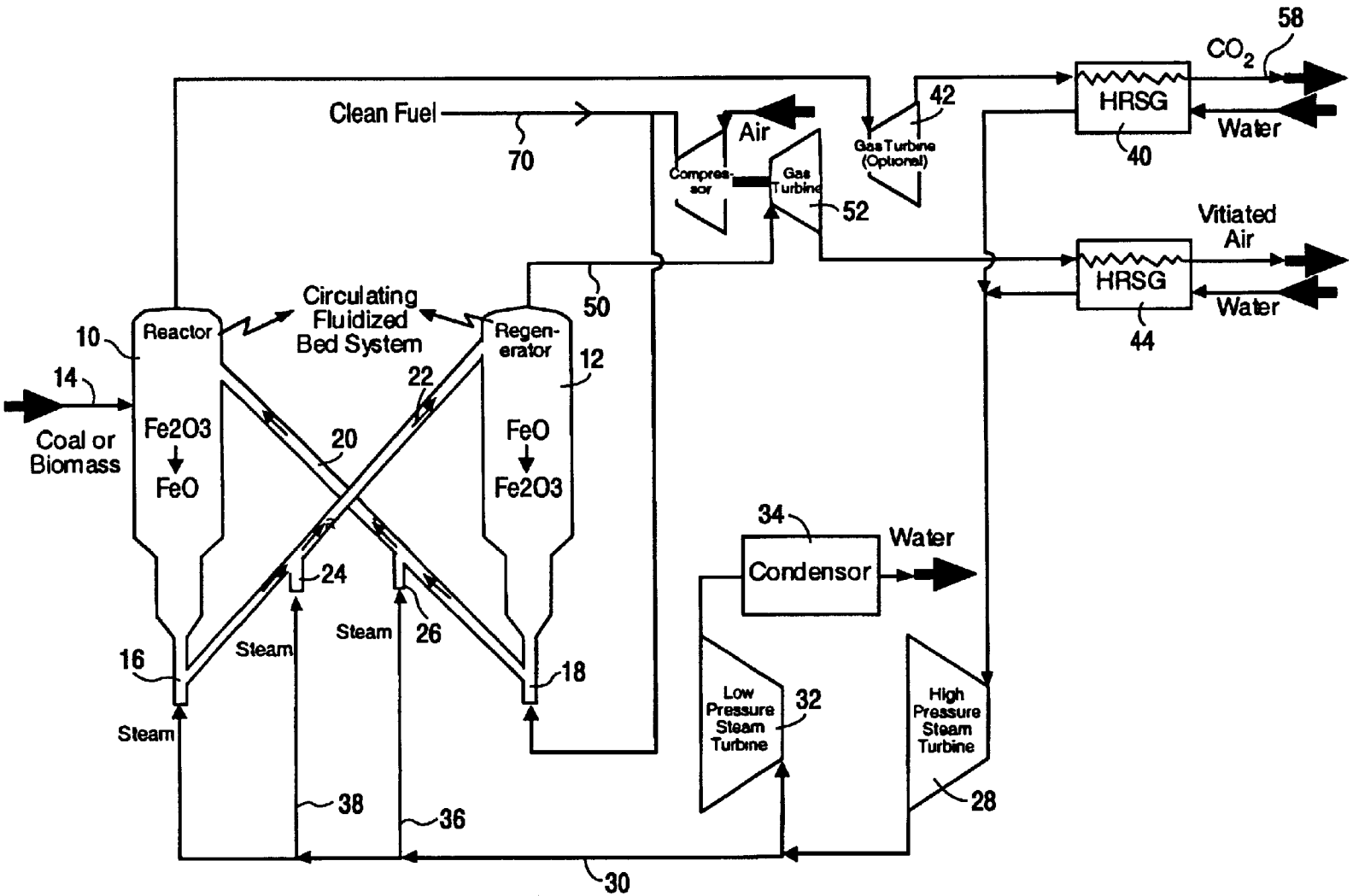
*Fig. 1* Circulating fluidized bed system

METHOD FOR EFFICIENT AND ENVIRONMENTALLY CLEAN UTILIZATION OF SOLID FUELS

BACKGROUND OF THE INVENTION

This invention relates to an improved method for using biomass and fossil fuels, such as coal, in order to power gas turbine engines using unmixed combustion of solid fuels. The invention also relates to a process for separating the products of unmixed combustion, including pollutants such as carbon dioxide, sulfur compounds, nitrogen compounds, and volatile metals (e.g., mercury) into a separate stream available for subsequent treatment and ultimate sequestration.

One of the major problems in modern industrial society is the production of air pollution by conventional combustion systems based on biomass and fossil fuels. The oldest recognized air pollution problem is the emission of smoke. In modern boilers and furnaces, smoke emissions could be eliminated or at least greatly reduced by the use of Over Fire Air ("OFA") technology. Other types of air pollution produced by combustion include particulate emissions such as fine particles of ash from pulverized coal firing, oxides of sulfur ($SO_2$ and $SO_3$), carbon monoxide emissions, volatile hydrocarbon emissions and the release of two oxides of nitrogen, NO and $NO_2$. More recently, the problem of global warming due to greenhouse gas emissions of $CO_2$ from power plants and other combustion systems have become a matter of serious environmental concern.

Another major technological problem concerns the use of coal as a fuel for powering gas turbines. Gas turbines are the lowest capital cost systems available for generating electrical power. Since the thermodynamic efficiency of gas turbines increases with increasing turbine inlet temperature, efforts to improve turbine efficiency generally involve increasing the turbine inlet temperature to higher levels. As a result, turbine blades and other components have been engineered to tolerate increasing high inlet temperatures.

It is well known that the hot gases produced by coal firing contain fly ash (which is erosive to turbine blades). In the presence of this erosive fly ash the maximum service temperature at which turbine blades can operate is less than it would be otherwise. This limitation significantly decreases the overall process efficiency and lowers the competitiveness of coal as a gas turbine fuel. These and other disadvantages have also prevented lower cost (and abundant) coal from being considered an attractive gas turbine fuel. If a process were developed whereby coal could be burned in a manner that produced hot gases that were not erosive or corrosive, the need for temperature reduction would be eliminated and coal would become a much more economically viable gas turbine fuel.

With respect to global warming, coal has the further disadvantage that its $CO_2$ emissions per BTU released are significantly higher than those of most ashfree fuels. Again, however, if coal could be burned in a manner that did not cause the emission of $CO_2$ and/or other pollutants, this known disadvantage would disappear, making coal a much more environmentally acceptable fuel for existing uses and new uses such as fueling gas turbines.

U.S. Pat. Nos. 5,339,754, 5,509,362 and 5,827,496 (incorporated herein by reference) disclose a new method of burning fuels using a catalyst that is readily reduced when in an oxidized state and readily oxidized when in a reduced state, with the fuel and air being alternatively contacted with the catalyst. The fuel reduces the catalyst and is oxidized to $CO_2$ and water vapor. In turn, the air oxidizes the catalyst and becomes depleted of oxygen. Combustion can thereby be effected without the need of mixing the fuel and air prior to or during the combustion process. If means are provided whereby the $CO_2$ and water vapor and the oxygen depleted air can be directed in different directions as they leave the combustion process, the mixing of fuel and air can be completely avoided. This particular method of combustion has become known in the art as "unmixed combustion." In one embodiment disclosed in the '362 patent, the $CO_2$ produced by the combustion process is separated from the water vapor and disposed of by conventional means. The '362 patent also removes the acid gases such as $SO_2$, HCl and HF.

It is well known that the total volume of combustion gases produced by unmixed combustion is comparable to that produced in conventional combustion. It is also well known that the cost of removing acid gases from combustion effluents by scrubbing increases with the volume of gas being scrubbed. The '362 patent recognize that if unmixed combustion is carefully controlled such that the acid gases leave the combustion process as part of the $CO_2$ and water vapor steam, the volume of gas that must be scrubbed can be greatly reduced, as well as the cost of scrubbing.

The subject matter of the '362 patent is discussed in greater detail in paper 98F36, presented at the October 1998 meeting of the Western States Section of the Combustion Institute (hereafter referred to as the "Combustion Institute paper"). The authors of the paper include R. K. Lyon (the inventor of U.S. Pat. No. 5,509,362 and the inventor of the present invention) and J. A. Cole. The paper discloses a conceptual process for using coal to power a gas turbine and reports on a series of experiments illustrating certain aspects of the proposed process.

The reported experiments used an atmospheric pressure fluid bed of powdered, chemically pure iron oxide (i.e., $FeO/Fe_2O_3$). In the experimental setup, the gas being used to fluidize the bed could be switched from air to 5% $SO_2$+95% $N_2$ and back again. The basic experiments as reported in the paper involved two steps. First, a bed fully oxidized to $Fe_2O_3$ was fluidized with the 5% $SO_2$+95% $N_2$ at a temperature of 857 @ C. A small amount of coal was injected into the bed while the gases leaving the bed were continuously analyzed. In a second step, the fluidizing gas was switched to air while the gases leaving the bed were analyzed. Based on available data, the paper concludes that coal is readily oxidized in the presence of $SO_2$ and that the chief carbon containing product of the oxidation is $CO_2$, with little or no CO being produced. The paper attributes the ability of the solid particles of $Fe_2O_3$ to rapidly oxidize the coal to a catalytic action by the $SO_2$ used in the fluidizing gas. That is, the $SO_2$ reacts with the coal, converting it into to $CO_2$, CO, $CS_2$, COS, and sulfur vapor. The CO, $CS_2$, COS, and sulfur vapor are, in turn, oxidized by the $Fe_2O_3$ to $CO_2$ and $SO_2$. Thus, the $SO_2$ serves as a catalyst, allowing the solid $Fe_2O_3$ to oxidize the solid coal char. The first half of this process, the gasification of coal char by $SO_2$, is described by J. D. Blackwood and D. J. McCarthy in the Australian J. Chem. P. 723, 1973.

The initial experiments reported in the Combustion Institute paper indicate that the gases exiting the bed after being fluidized with air contain little or no $SO_2$ and little or no CO and $CO_2$. Thus, the paper concludes that the $Fe_2O_3$ oxidized the coal to completion during the first step, i.e., while the bed was fluidized with 5% $SO_2$+95% $N_2$. The oxidation converted all the sulfur in the coal to $SO_2$ and other volatile species which exited the bed during the first step of the experiment.

Another series of two-step experiments discussed in the paper used a bed fluidized with $N_2$. Like the experiments conducted with coal, when the amount of thiophene injected was small, all of the sulfur left the bed as $SO_2$ and other volatile species during the first step. Conversely, none of the sulfur was retained in the bed during the first step and exited during the second air fluidization step. Increasing the amount of injected thiophene changed that situation. That is, injecting thiophene in excess of a threshold amount caused some of the sulfur to be retained in the bed during the first step and to be released as $SO_2$ during the second air fluidization step. The paper speculates that this threshold is a result of FeS, i.e., after thiophene reduces some of the $Fe_2O_3$ to FeO, injection of more thiophene causes the formation of FeS. Once formed, the FeS remains during the first step and then oxidizes to $Fe_2O_3$ and $SO_2$ during the air fluidization step.

Based on these experimental observations, the Combustion Institute paper then proposes a conceptual design for a process to use coal to power a gas turbine. As shown in The reference's FIG. 4, the $Fe_2O_3$ catalyst in fluidized powder form circulates between a first fluid bed fluidized with steam and a second bed fluidized with air. FIG. 4 shows the transfer lines between two fluid beds as being purged with steam. The second fluid bed is fluidized with compressed air from the compressor section of a gas turbine. With this bed, FeO is oxidized to $Fe_2O_3$, a strongly exothermic reaction that depletes the compressed air of oxygen and heats it. The heated compressed air is then used to drive the expander section of the gas turbine.

The Combustion Institute paper contemplates feeding pulverized coal to the first steam fluidized bed where it reduces the $Fe_2O_3$ to FeO while being oxidized to $CO_2$, water vapor, and fly ash. All the volatile products of combustion are swept from the bed. The fluidization conditions in the bed are such that the fly ash is rapidly removed from the bed by elutriation. FIG. 4 calls for the fly ash to be removed from the other combustion products with a cyclone separator after which the ash goes to disposal. Once heat is recovered from the remaining combustion products, water vapor is removed by condensation and the resultant $CO_2$ and $SO_2$ mixture is disposed of.

The Combustion Institute paper concludes that the conditions under which the coal is oxidized are such that all or virtually all of the sulfur in the coal is converted to $SO_2$ and other volatile species rather than reacting with the FeO/$Fe_2O_3$ to form FeS or other nonvolatile sulfur containing species. Obviously, the formation of FeS and similar species is undesirable from an environmental standpoint. Instead of being swept out of the steam fluidized bed, they tend to circulate into the air fluidized bed where they oxidize to $SO_2$ and cause the emission of air pollutants.

Three final aspects of the Combustion Institute paper should also be noted. First, the paper teaches that if the conversion of $Fe_2O_3$ to FeO is kept below a certain threshold, FeS is not formed and $SO_2$ emissions are avoided. Although the paper notes the amount of thiophene needed to exceed this threshold for the amount of $Fe_2O_3$ used in the experiment, it is silent as to how much $Fe_2O_3$ was used. Thus the paper does not identify the extent of $Fe_2O_3$ conversion at which the threshold occurs. Nor does it explain how a change in temperature effects the threshold or how catalyst aging changes the threshold. The paper also fails to disclose how the threshold would be effected by changing the form in which the $Fe_2O_3$ is used, e.g., replacing chemically pure $Fe_2O_3$ with iron ore, red mud (a byproduct of aluminum production with a high iron content) or other low cost iron containing products.

With respect to the problem of achieving complete combustion of the coal, the Combustion Institute paper teaches that 5% $SO_2$ as used in the paper's experiment corresponds to the concentration of $SO_2$ produced in the proposed process, i.e., the concentration of $SO_2$ in moles per liter which would be produced by oxidation of high sulfur Illinois coal with $Fe_2O_3$ at a sufficiently elevated pressure. For lower sulfur coals, the concentration of $SO_2$ will be lower, making the coal oxidation rate unacceptably low. The only solution suggested for this problem is very expensive, namely raising the $SO_2$ concentration by recycling $SO_2$, i.e., by recovering $SO_2$ from the recovered $SO_2$+$CO_2$ mixture and returning it to the first fluid bed.

It is well known that efficient coal combustion requires that the carbon content of the fly ash be low. The Combustion Institute paper's experiments show that coal can be rapidly oxidized to $CO_2$, water vapor and "fly ash." However, a coal particle becomes "fly ash" when oxidation shrinks it to the point that it flies out of the fluid bed. While this implies that the "fly ash" would have a substantial carbon content, the paper does not identify the carbon content of the fly ash. The reference's FIG. 4 contemplates removing fly ash from the gases leaving the first fluid bed with a cyclone and sending this fly ash to disposal. However, this would mean discarding a significant fraction of the coal's heat of combustion.

It is also known that the theoretical maximum possible efficiency of a gas turbine increases with increasing turbine inlet temperature. Thus, if a gas turbine is to operate with an acceptably high efficiency, the inlet temperature should be at temperatures approaching 1500° C. For the conceptual process shown in The reference's FIG. 4, the turbine inlet temperature would be the same or slightly less than the temperature at which the second fluid bed operates. On page 10, the paper teaches that the first fluid bed is to be operated at a temperature of 700° C.–900° C. Within the framework of the reference's FIG. 4 conceptual process, this teaching is necessary since the first fluid bed must be operated at a temperature below the coal's ash fusion temperature.

The Combustion Institute paper teaches that the second fluid bed should be operated at a temperature of "nearly 1500° C." This teaching is necessary if the gas turbine is to operate with satisfactory efficiency and implies a temperature increase of 600° C. to 800° C. In order to provide this temperature increase, the paper teaches that the ratio of coal to $Fe_2O_3$ feed to the first bed be sufficient so that 60% of the $Fe_2O_3$ is reduced to FeO. One can readily calculate that if a stoichiometric quantity of air is preheated to 400° C. and reacts adiabatically with $Fe_2O_3$ 60% of which has been reduced to FeO, the final temperature will be 1495.2° C.

However, important limitations exist with respect to the catalyst under such conditions. The threshold for FeS formation must be 60% conversion or greater if $SO_2$ emissions are to be avoided. The catalyst must consist almost entirely of $Fe_2O_3$/FeO, i.e., if the catalyst contained any substantial amount of inert material, the added heat capacity of this inert material would reduce the temperature increase. The Combustion Institute paper thus requires the use of pure or nearly pure $Fe_2O_3$/FeO, a relatively expensive material, rather than much less expensive iron ore or red mud. Furthermore, aging of the expensive $Fe_2O_3$/FeO catalyst effectively converts it into an inert heat capacity. Thus, the teachings of the paper imply that the catalyst life will be short since relatively little catalyst aging can be tolerated. The paper also confirms the disadvantage in having sulfur in the coal recovered as $SO_2$. There is virtually no market for sulfur as $SO_2$ and its storage and disposal can be expensive and difficult. In contrast, elemental sulfur is readily shipped and has a substantial market potential. Moreover, in situations in which it cannot be sold, the storage and/or disposal of sulfur is relatively easy and inexpensive.

Thus, despite recent developments in the art, a significant need still exists in the art for a new method of burning coal to power gas turbines that will avoid the limitations discussed above with respect to the unmixed combustion of solid fuels such as coal.

BRIEF SUMMARY OF THE INVENTION

The present invention provides an improved method of burning coal to power gas turbines, and achieves high efficiency while controlling $SO_2$, $CO_2$, Hg and $NO_x$ emissions. The invention also provides an improved method of burning coal as compared to the prior art (including the Combustion Institute paper) that allows the use of catalysts other than high purity $Fe_2O_3$/FeO (i.e., iron oxides with a significant fraction becoming inert due to aging and in mixture with inert noncatalytic materials). The invention also provides a method of efficiently separating all the pollutants, including $CO_2$, sulfur compounds, nitrogen compounds, and volatile metals, such as mercury, into a separate stream for downstream treatment or disposal.

BRIEF DESCRIPTION OF THE DRAWINGS

FIG. 1 is a schematic diagram of a circulating fluidized bed system in accordance with one embodiment of the invention.

DETAILED DESCRIPTION OF THE INVENTION

With reference to FIG. 1, a mixture of coal and steam is fed to a first fluidized bed reactor 10 and air is fed to a second fluidized bed reactor 12 (labeled "Regenerator" in FIG. 1). Coal or biomass is supplied to the first reactor 10 via inlet 14 (which can be an airlock type inlet) at about the midpoint of fluidized bed 10, while steam is supplied to the bottom of the reactor via inlet 16. Air is supplied to the bottom of the second reactor 12 via inlet 18. A catalyst containing iron oxides (FeO and $Fe_2O_3$) is circulated between the two fluidized beds 10, 12 via crossover conduits 20, 22 in order to transfer oxygen present in the system. The connections between the fluidized beds are isolated by flowing steam via inlets 24, 26 to prevent the crossover of gases.

Steam for the first fluidized bed reactor 10 is primarily supplied by a high pressure steam turbine 28 via stream 30. Some the steam is supplied to a low pressure steam turbine 32 and then to condenser 34. A portion of the steam is also extracted for supply to the crossover conduits 20, 22 via respective streams 36, 38. In the first fluidized bed 10, the $Fe_2O_3$ is reduced to FeO.

27. As the coal particles react, they become smaller and are carried to the top of the fluidized bed 10. Meanwhile, fresh $Fe_2O_3$ is introduced at the top of the fluidized bed 10 and circulates throughout the bed as it is converted to FeO. At the bottom of the first fluidized bed, the FeO is conveyed through a vapor lock and conduit 22 to the top of the second fluidized bed 12. The gas stream leaving the first fluidized bed 10 is then fed to a cyclone separator (not shown) or other conventional hot gas cleanup systems known in the art to remove ash. If the gas stream is to be discharged to the atmosphere it may undergo further purification or, if it is to be sent to sequestration it may need no further processing.

If the amount of MO is sufficient to complete the combustion process in the first fluidized bed 10, final combustion products ($CO_2$ and $H_2O$) are formed. The product gas can be cooled in a heat recovery steam generator ("HRSG") 40 to produce steam. The product gas consists of $CO_2$, $H_2O$, and $SO_2$ at elevated pressure, with small amounts of other pollutants. The $SO_2$ and other pollutants can be removed by conventional wet scrubbing or other treatment (also not shown), leaving an essentially pure stream 58 of pressurized $CO_2$ for sequestration or discharge.

Alternatively, the $SO_2$ and other air pollutants can be removed in a gas cleanup system and the product gas expanded across gas turbine 42 (labeled "Gas Turbine (optional)") to produce electricity. The gas can then be cooled in HRSG 40, and the product gas 58 (mostly $CO_2$), now almost at atmospheric pressure, discharged or sequestered.

As noted above, the second fluidized bed 12 in FIG. 1 is fluidized with air which oxidizes the FeO to $Fe_2O_2$. Clean fuel such as natural gas can, depending on operating conditions, be added to the air via line 70. The oxidation of this clean fuel in fluidized bed 12 provides additional heat. The gas stream 50 leaving the second fluidized bed 12 typically passes through a cyclone or other hot gas cleanup system (not shown) to remove elutriated metal oxides. The product gas from the second fluidized bed consists of vitiated air, which is then expanded across gas turbine 52. The second fluidized bed may consist of a bubbling fluidized bed or a riser reactor.

The remaining enthalpy in the different streams outlined in FIG. 1 can be recovered in HRSG units, thereby providing steam for fluidization, steam for purging the vapor locks and steam for generation of electricity in the steam turbines.

One of the potential advantages of the preferred method for coal conversion according to the invention is the ability to greatly limit the formation of $NO_x$. The oxidation of the clean fuel and of FeO to $Fe_2O_3$ occurs at a temperature too low for formation of thermal $NO_x$ by nitrogen fixation. If the clean fuel does not contain chemically bound nitrogen, there will be no formation of fuel $NO_x$. In addition to the thermal $NO_x$ and fuel $NO_x$ mechanisms for forming $NO_x$ there is a minor mechanism known as the prompt $NO_x$ mechanism. $NO_x$ formation by this mechanism is always small and since the clean fuel is used in limited amounts, the formation of $NO_x$ by this means is further limited.

The present invention also contemplates means for efficiently controlling the systems for coal conversion, namely (1) continuous monitoring the $SO_2$ content of the oxygen depleted air as it exits the turbine; (2) adjusting the rate at which coal is fed to the first fluid bed; (3) continuous monitoring of the temperature of the second fluid bed; and (4) adding a controlled amount of natural gas or other clean fuel to the second fluid bed. In this context, the term "clean fuel" relates to the applicable federal emission regulations. That is, a fuel with a relatively low sulfur content might not be considered a "clean fuel" in regions in which emission regulations are extremely strict, even though it might be so defined in other regions.

A typical example of the continuous monitoring of $SO_2$ may be described as follows. A signal from the $SO_2$ monitor is sent to the mechanism controlling the coal input rate, causing it to increase the coal input rate when the $SO_2$ level in the gases leaving the turbine is below an acceptable value, and to decrease the coal rate when the $SO_2$ level exceeds the acceptable value. In this manner, the rate at which coal is fed to the first fluid bed (item 64 in FIG. 2) is adjusted to the threshold of incipient FeS formation and maintained at that threshold despite variations in the value due to catalyst aging or other causes.

42. In like manner, a signal from the temperature monitor on the second fluid bed 66 is sent to the mechanism controlling the clean fuel input rate, causing it to increase the clean fuel input rate when the bed temperature falls below a preset value, and to decrease the fuel rate when the bed temperature exceeds the preset value. The bed operates under conditions whereby the clean fuel readily oxidizes, delivering heat to the said second bed in addition to that which is provided by the oxidation of FeO to $Fe_2O_2$. In this manner, the total rate of heat release in the second bed is held constant despite variations in the amount of heat produced by oxidation of FeO to $Fe_2O_3$ in the second fluid bed, thus maintaining the temperature of the gases going into the gas turbine at a constant high valve and ensuring better turbine efficiency.

EXAMPLE 1

Various experiments were conducted to reduce a sample of pure $Fe_2O_3$ with thiophene at 732° C. and reoxidizing it with air. For reductions of the $Fe_2O_3$ of less than 60%, the subsequent reoxidation did not produce $SO_2$.

EXAMPLE 2

Heat balance calculations were done for the 60% reduction of $Fe_2O_3$ to FeO at 900° C. and for the subsequent reoxidation under adiabatic conditions with 150% stoichiometric air, the air being preheated to a temperature of 400° C. The oxygen depleted air was found to exit the second fluid bed at 1487.5° C.

EXAMPLE 3

The heat balance calculation in comparative example 2 was repeated but with the pure $Fe_2O_3$ being replaced with a mixture of 50 mole % $Fe_2O_3$, 50 mole $SiO_2$. The oxygen depleted air exited the second fluid bed at 1337.70° C.

Comparative examples 2 and 3 show that the process described by the Combustion Institute paper can generate gases hot enough to efficiently power a gas turbine, i.e., temperatures approaching 1500° C., but that this ability is lost (or substantially reduced) when the catalyst is diluted with inert materials.

EXAMPLE 4

The heat balance calculation in comparative example 3 concerned the case in which 3% $CH_4$ (natural gas) is added to the air going into the second fluid bed. The oxygen depleted air was found to exit the second fluid bed at 1516.5° C. This illustrates that the addition of a clean fuel will maintain the temperature at a level consistent with high turbine efficiency while allowing the effective use of coal as the solid fuel.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for using a solid fuel containings ash and sulfur to power gas turbine engines using an unmixed combustion catalyst capable of being reduced oxidized state and being oxidized when in a reduced state, comprising the steps of:

circulating said unmixed combustion catalyst between two fluid bed reactors to cause the catalyst to become reduced by said ash containing fuel in the first fluid bed reactor and oxidized by air in the second fluid bed reactor;

removing ash and $SO_2$ gases from said first fluid bed reactor;

measuring the amount of $SO_2$ in the gases leaving said second fluid bed reactor;

controlling the rate of said ash containing fuel addition to said first fluid bed reactor based on the measured amount of $SO_2$ in the gases leaving said second fluid bed reactor; and controlling the temperature within said second fluid bed reactor using a clean fuel.

2. The process of claim 1 wherein said clean fuel does not contain chemically bound nitrogen.

3. The process of claim 1 wherein said clean fuel is natural gas.

4. The process of claim 1 wherein natural gas is added to said air prior to the air entering the said second fluid bed.

5. The process of claim 1 wherein the preferred oxygen transfer catalyst material is iron oxide.

6. The process of claim 5 wherein said metal oxides are used in the form of ore, ore waste products, or ore byproducts and have a metal purity of less than 90%.

7. The process of claim 1 wherein the amount of said unmixed combustion catalyst and residence time in the reactors are sufficient to provide complete oxidation of said solid fuel.

* * * * *